US011781385B1

(12) United States Patent
Xiao et al.

(10) Patent No.: US 11,781,385 B1
(45) Date of Patent: Oct. 10, 2023

(54) SUBSEA COILED TUBING DRILLING SYSTEM AND SUBSEA DRILLING DEVICE THEREOF

(71) Applicant: China University of Petroleum (East China), Qingdao (CN)

(72) Inventors: Wensheng Xiao, Qingdao (CN); Qingxue Zhang, Qingdao (CN); Junguo Cui, Qingdao (CN); Lianpeng Mei, Qingdao (CN); Teng Wang, Qingdao (CN); Jiangtao Mei, Qingdao (CN)

(73) Assignee: China University of Petroleum (East China), Qingdao (CN)

( * ) Notice: Subject to any disclaimer, the term of this patent is extended or adjusted under 35 U.S.C. 154(b) by 0 days.

(21) Appl. No.: 18/147,876

(22) Filed: Dec. 29, 2022

(30) Foreign Application Priority Data

Oct. 12, 2022 (CN) ..... 202211247968.5

(51) Int. Cl.

| | |
|---|---|
| ***E21B 4/04*** | (2006.01) |
| ***E21B 15/02*** | (2006.01) |
| ***E21B 19/22*** | (2006.01) |
| ***E21B 33/035*** | (2006.01) |
| ***E21B 33/05*** | (2006.01) |
| ***E21B 33/14*** | (2006.01) |

(Continued)

(52) U.S. Cl.
CPC ..... *E21B 19/22* (2013.01); *E02D 27/525* (2013.01); *E21B 4/04* (2013.01); *E21B 15/003* (2013.01); *E21B 15/02* (2013.01); *E21B 33/035* (2013.01); *E21B 33/05* (2013.01); *E21B 33/143* (2013.01)

(58) Field of Classification Search
CPC ..... E21B 4/04; E21B 15/003; E21B 15/02; E21B 19/22; E21B 33/035; E21B 33/05; E21B 33/143; E02D 27/525
See application file for complete search history.

(56) References Cited

U.S. PATENT DOCUMENTS

| | | | | |
|---|---|---|---|---|
| 6,488,093 | B2 * | 12/2002 | Moss | E21B 19/22 166/365 |
| 2018/0355674 | A1 * | 12/2018 | Cooper | E21B 43/01 |
| 2020/0270951 | A1 * | 8/2020 | Xiao | E21B 19/008 |

FOREIGN PATENT DOCUMENTS

| | | | | |
|---|---|---|---|---|
| CN | 109944548 | A | 6/2019 | |
| CN | 114961563 | A | 8/2022 | |
| WO | WO-2007129899 | A1 * | 11/2007 | E21B 19/143 |

* cited by examiner

*Primary Examiner* — Matthew R Buck
(74) *Attorney, Agent, or Firm* — Westman, Champlin & Koehler, P.A.

(57) ABSTRACT

A subsea coiled tubing drilling system and a subsea drilling device thereof are provided. The subsea drilling device includes an underwater derrick, a well head device and a dual-roller coiled tubing device, the dual-roller coiled tubing device includes an injection head, a roller for drilling and a roller for running casing, the injection head is arranged right above the well head device, the roller for drilling and the roller for running casing are distributed on two sides of the injection head; both the drilling coiled tubing and the casing running coiled tubing are capable of respectively penetrating through the injection head and the well head device in sequence. Drilling and casing running operations can be realized on the basis of not moving the underwater derrick or changing the self structure state of the underwater derrick, and operation steps can be simplified, and the work efficiency can be improved.

17 Claims, 5 Drawing Sheets

(51) Int. Cl.
*E02D 27/52* (2006.01)
*E21B 15/00* (2006.01)

SUBSEA COILED TUBING DRILLING SYSTEM AND SUBSEA DRILLING DEVICE THEREOF

CROSS-REFERENCE TO RELATED APPLICATION

This patent application claims the benefit and priority of Chinese Patent Application No. 202211247968.5, entitled "SUBSEA COILED TUBING DRILLING SYSTEM AND SUBSEA DRILLING DEVICE THEREOF" filed on Oct. 12, 2022, the disclosure of which is incorporated by reference herein in its entirety as part of the present application.

TECHNICAL FIELD

The present disclosure relates to the technical field of offshore drilling equipment, and in particular, to a subsea coiled tubing drilling system and a subsea drilling device thereof.

BACKGROUND

Natural gas hydrate is an efficient and clean energy with abundant resources, which is reserved 500 meters below a seabed at an ocean water depth of 800 to 5000 meters. At present, China has completed two rounds of producing tests of the natural gas hydrate, which both use a semi-submersible drilling platform. The construction cost of the platform is huge, and the drilling efficiency is low.

The adoption of a subsea drilling rig that performs a drilling operation mode at a deep-water subsea is a feasible way for relatively economic development of the natural gas hydrate in a sea area. However, there are few subsea drilling rigs for offshore natural gas hydrate drilling in the prior art.

Chinese Patent Application Publication No. CN 109944548 A discloses a subsea drilling rig drilling system and a method. The system includes a barge, an umbilical cable, a subsea device, and a drilling device. A gas-eletro-hydraulic control device and a mud treatment device are loaded on the barge. The gas-eletro-hydraulic control device and the mud treatment device are connected to the subsea device through the umbilical cable. The subsea device includes a subsea traveling device, a coiled tubing roller, a derrick, a concentrated valve seat, a drill bit replacement device, a well head device, and a casing rack. The concentrated valve seat is connected to the umbilical cable, and is configured for shunting the mud signal, cement signal, and electrical signal transmitted by the umbilical cable. The derrick is mounted above the well head device, and is matched with each of the drill bit replacement device and the casing rack, and is used for performing a drill bit replacing operation, and casing conveying and winding back operations. The drilling device is connected to a coiled tubing, and is used for performing a drilling operation. In the solution, when a casing running operation is performed, the subsea traveling device needs to be controlled to move to a designated place via the gas-eletro-hydraulic control device, and then a casing handling device is controlled by the gas-eletro-hydraulic control device to grab a casing from the casing rack. This process has high requirements on a control system, and it needs to spent time in operations of traveling and centering. The casing running operation will also be affected seriously if matching positions of both the casing rack and the well head device are not accurate.

Chinese Patent Application Publication No. CN 114961563 A discloses a deep-water subsea coiled tubing drilling rig, which includes a lifting frame. The lifting frame includes an upper frame and a lower frame nested with each other and connected with each other via a lifting device. The upper frame and the lower frame are enclosed to form a working space. An underwater connecting and unloading tool is mounted inside the working space. The working space forms a high-position large space state for tool connecting and unloading and a low-position small space state for a drilling process with the up-down movement of the upper frame. The upper frame is provided with an underwater coiled tubing system used for lowering and lifting a downhole tool combination. The lower frame is provided with a well head device. In the solution, the lifting frame is arranged to realize the conversion between the high-position large space state and the low-position small space state, and the tool connecting and unloading processes and drilling process are performed in different states respectively. A casing running operation can be realized without displacing. However, the lifting frame needs to have a lifting function, the structure is complex, a casing running process is tedious, and the work efficiency needs to be improved.

SUMMARY

An objective of the present disclosure is to provide a subsea coiled tubing drilling system and a subsea drilling device thereof, so as to solve the abovementioned problems in the prior art. A drilling coiled tubing and a coiled tubing as a casing are provided respectively by a roller for drilling and a roller for running casing arranged on an underwater derrick. Through the cooperation of an injection head and a well head device, the drilling coiled tubing and the coiled tubing as a casing respectively enter a well according to the requirements, so that drilling and casing running operations can be realized on the basis of not moving the underwater derrick or not changing the self structure of the underwater derrick. Further, operation steps can be simplified, and the work efficiency can be improved.

In order to achieve the abovementioned objective, the present disclosure provides the following solutions.

The present disclosure provides a subsea drilling device, which includes an underwater derrick, and a well head device and a dual-roller coiled tubing device respectively mounted at a bottom and a top of the underwater derrick, where the dual-roller coiled tubing device includes an injection head, a roller for drilling and a roller for running casing, the injection head is arranged right above the well head device, the roller for drilling and the roller for running casing are distributed on two sides of the injection head; the roller for drilling is configured for winding and unwinding a drilling coiled tubing; the roller for running casing is configured for winding and unwinding a coiled tubing as a casing; and both the drilling coiled tubing and the coiled tubing as a casing are capable of respectively penetrating through the injection head and the well head device in sequence.

In embodiments, the roller for drilling and the roller for running casing may be respectively arranged on the underwater derrick via a first guide rail and a second guide rail; and both a moving track of the roller for drilling on the first guide rail and a moving track of the roller for running casing on the second guide rail are capable of corresponding to the injection head.

In embodiments, the subsea drilling device may include a casing running auxiliary device, the casing running auxiliary device may include a first mechanical arm arranged close to the injection head and a second mechanical arm arranged close to the well head device.

In embodiments, in an initial state, the drilling coiled tubing may be mounted inside the injection head and the well head device; before running a casing, the drilling coiled tubing may be wound back; the first mechanical arm may be configured for mounting the coiled tubing as a casing into the injection head; and the second mechanical arm may be configured for mounting the coiled tubing as a casing into the well head device.

In embodiments, the subsea drilling device may include a downhole tool combination, where a connector may be arranged at a top end of the downhole tool combination, and the connector may be configured for connecting with the drilling coiled tubing; and an electric drill may be arranged at a bottom end of the downhole tool combination, and the electric drill may be configured for drilling a borehole.

The present disclosure further provides a subsea coiled tubing drilling system, which includes the aforementioned subsea drilling device, an auxiliary vessel, and a connecting pipe cable for connecting the subsea drilling device and the auxiliary vessel, where the connecting pipe cable includes a sling, an umbilical cable, and a material conveying pipe.

In embodiments, the well head device may include a well head base; a guide pipe may be arranged at a bottom of the well head base; and a cement head and a blowout preventer may be arranged at a top of the well head base in sequence from bottom to top.

In embodiments, the material conveying pipe may include a cement conveying pipe and a mud conveying pipe; a mud and cement system and a control system may be arranged on the auxiliary vessel; a hydraulic power station may be arranged on the subsea drilling device; one end of the cement conveying pipe may be connected to the mud and cement system, and an other end of the cement conveying pipe may be connected to the cement head; one end of the mud conveying pipe may be connected to the mud and cement system, and an other end of the mud conveying pipe may be connected to the drilling coiled tubing; and one end of the umbilical cable may be connected to the control system, and an other end of the umbilical cable may be connected to the hydraulic power station.

In embodiments, the subsea coiled tubing drilling system may include a suction pile device, where the suction pile device may include pile buckets mounted on a periphery of a bottom of the underwater derrick and a pump system that communicates with the pile buckets; and the pump system may be configured for filling water into the pile buckets or discharging water from the pile buckets.

In embodiments, the guide pipe and the pile buckets may be all lower than the underwater derrick; and the guide pipe and the pile buckets enter the mud together when the subsea drilling device is lowered.

Compared with the prior art, the present disclosure achieves the following technical effects.

(1) In embodiments, the drilling coiled tubing and the coiled tubing as a casing are provided respectively by the roller for drilling and the roller for running casing arranged on an underwater derrick. Through the cooperation of the injection head and the well head device, the drilling coiled tubing and the coiled tubing as a casing respectively enter the well according to the requirements, so that drilling and casing running operations can be realized on the basis of not moving the underwater derrick or not changing the self structure of the underwater derrick. Further, operation steps can be simplified, and the work efficiency can be improved. The subsea drilling device is directly placed into a subsea, which can reduce the drilling cost compared with a semi-submersible drilling platform. A structure with a dual-roller coiled tubing device is adopted, which can realize the operation of drilling once and running the casing once. So, the connecting time is omitted, and the drilling efficiency is greatly improved.

(2) In embodiments, the moving track of the roller for drilling on the first guide rail and the moving track of the roller for running casing on the second guide rail can correspond to the injection head. When the drilling coiled tubing and the coiled tubing as a casing are wound and unwound, the drilling coiled tubing and the coiled tubing as a casing can be ensured to be directly aligned with the injection head, the smoothness of the winding and unwinding processes can be ensured, and the sticking and the abrasion of the drilling coiled tubing and the coiled tubing as a casing can be avoided.

(3) In embodiments, in the initial state, the drilling coiled tubing is mounted in the injection head and the well head device first, drilling coiled tubing is wound back before running the casing, and the first mechanical arm and the second mechanical arm are only required to perform actions when running the coiled tubing as a casing. Therefore, the mechanical arms with relatively simple structures and functions are adopted, which avoids complex structures thereof caused by over-high requirements on the action states of the mechanical arms, and can improve the stability and reliability of the operation of the mechanical arms.

(4) In embodiments, the underwater derrick is fixed by using the suction pile device. The lifting movement of the underwater derrick is realized by using the lifting of the pile buckets before fixing. The guide pipe of the well head device and the pile buckets of the suction pile device are all arranged to be lower than the underwater derrick, so that the guide pipe can be buried into the subsea mud synchronously when the underwater derrick is lowered. Therefore, the position of a well head can be determined while mounting the underwater derrick, and the drilling coiled tubing and the coiled tubing as a casing can be fed into the well smoothly by using the well head device, so that the drilling and casing running operations can be completed smoothly.

BRIEF DESCRIPTION OF THE DRAWINGS

To describe the technical solutions in the embodiments of the present disclosure or in the prior art more clearly, the following briefly describes the drawings required for describing the embodiments. Apparently, the drawings in the following description are merely some embodiments of the present disclosure, and those of ordinary skill in the art may still derive other drawings from these drawings without creative efforts.

Figure 1:
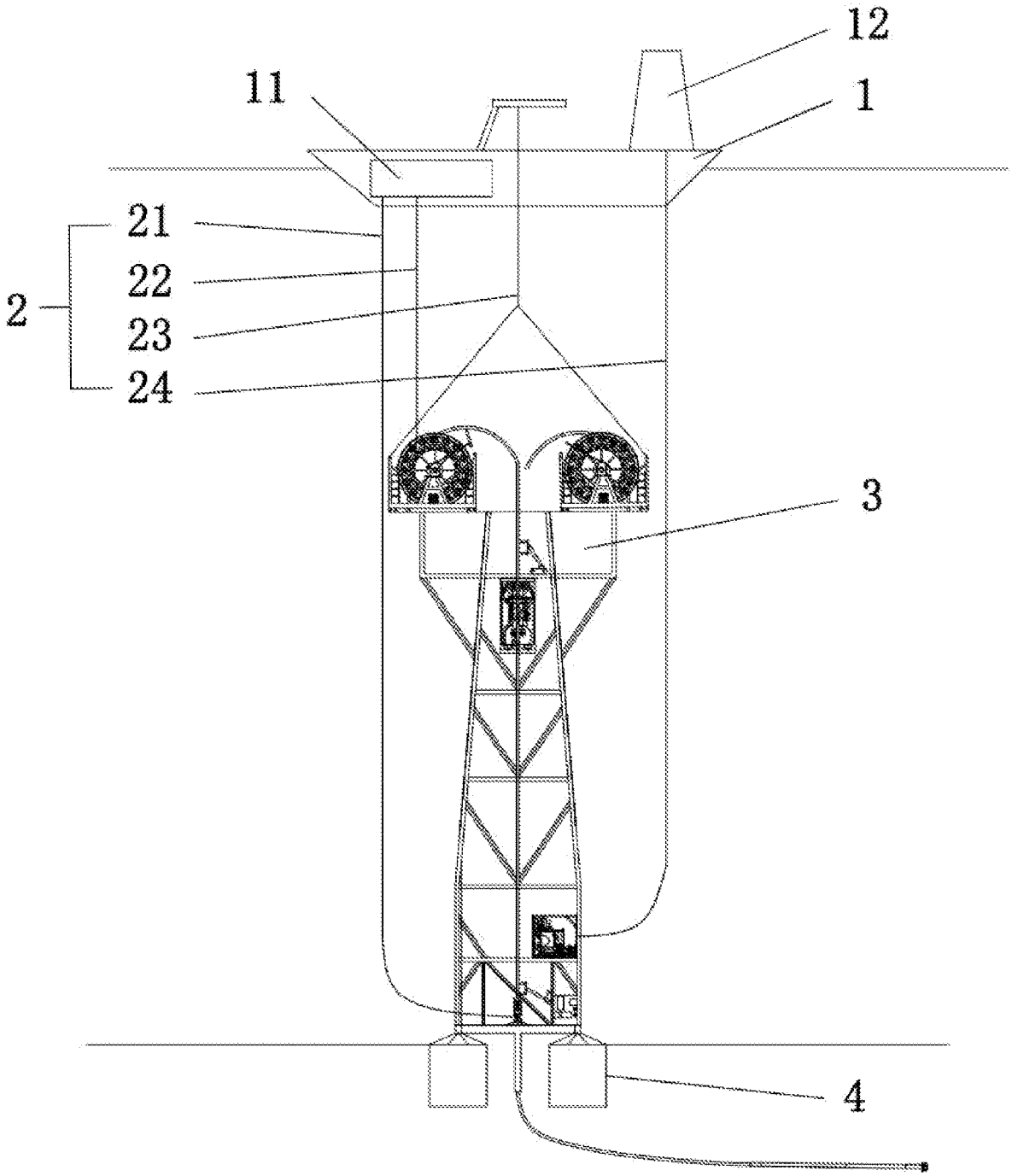
FIG. 1 is a schematic diagram of a subsea coiled tubing drilling system according to the embodiments of the present disclosure.

Reference signs in the drawings: 1-auxiliary vessel; 11-mud and cement system; 12-control system; 2-connecting pipe cable; 21-cement conveying pipe; 22-mud conveying pipe; 23- sling; 24-umbilical cable; 3- subsea drilling device; 31-underwater derrick; 32-dual-roller coiled tubing device; 321-roller for drilling; 322-drilling coiled tubing; 323-roller for running casing; 324-coiled tubing as a casing; 325-injection head; 326-guide rail device; 3261-first guide rail; 3262-second guide rail; 33-casing running auxiliary device; 331-first mechanical arm; 332-second mechanical arm; 34-hydraulic power station; 35-downhole tool combination; 351-electric drill; 352-connector; 36-well head device; 361-well head base; 362-cement head; 363-blowout preventer; 364-guide pipe; 4-suction pile device; 41-pile bucket; and 42-pump system.

DETAILED DESCRIPTION OF THE EMBODIMENTS

Technical solutions in the embodiments of the present disclosure will be clearly and completely described below with reference to the drawings in the embodiments of the present disclosure. Apparently, the described embodiments are merely part rather than all of the embodiments of the present disclosure. On the basis of the embodiments of the present disclosure, all other embodiments obtained by those of ordinary skill in the art without creative work fall within the scope of protection of the present disclosure.

An objective of the present disclosure is to provide a subsea coiled tubing drilling system and a subsea drilling device thereof, so as to solve the problems in the prior art. A drilling coiled tubing and a coiled tubing as a casing are provided respectively by a roller for drilling and a roller for running casing arranged on an underwater derrick. Through the cooperation of an injection head and a well head device, the drilling coiled tubing and the coiled tubing as a casing respectively enter a well according to the requirements, so that drilling and casing running operations can be realized on the basis of not moving the underwater derrick or not changing the self structure of the underwater derrick. Further, operation steps can be simplified, and the work efficiency can be improved.

In order to make the abovementioned objective, features, and advantages of the present disclosure more apparent and more comprehensible, the present disclosure is further described in detail below with reference to the drawings and specific embodiments.

As shown in FIG. 1 to FIG. 6, the present disclosure provides a subsea drilling device 3, which includes an underwater derrick 31, and a well head device 36 and a dual-roller coiled tubing device 32 that are respectively mounted at the bottom and the top of the underwater derrick 31. The underwater derrick 31 is a support lowered to a subsea, which may adopt a frame-form structure or a pipe truss-form structure, and is mainly used for carrying drilling equipment, casing running equipment, etc., so as to be erected above a well head to perform drilling and casing running operations. The well head device 36 is fixed above the well head. A drilling coiled tubing 322 or a coiled tubing as a casing 324 is fed into a well through the well head device 36. Moreover, through the well head device 36, mud may be conveyed into the well during drilling or cementing materials such as cement may be conveyed after the drilling is completed. The dual-roller coiled tubing device 32 includes an injection head 325, a roller for drilling 321 and a roller for running casing 323. The injection head 325 is arranged right above the well head device 36, and the roller for drilling 321 and the roller for running casing 323 are distributed on both sides of the injection head 325. The roller for drilling 321 is wound with the drilling coiled tubing 322. The drilling coiled tubing 322 may be wound or unwound by rotating the roller for drilling 321. The roller for running casing 323 is wound with the coiled tubing as a casing 324. The coiled tubing as a casing 324 may be wound or unwound by rotating the roller for running casing 323. The injection head 325 adopts an injection head 325 in the prior art, which can provide power for conveying the drilling coiled tubing 322 and the coiled tubing as a casing 324. When a drilling operation is performed, the drilling coiled tubing 322 can penetrate through the injection head 325 and the well head device 36 in sequence, and enter the well. When a casing running operation is performed, the coiled tubing as a casing 324 can penetrate through the injection head 325 and the well head device 36 in sequence, and enter the well. It is to be noted that, in order to facilitate the penetrating of the drilling coiled tubing 322 and the coiled tubing as a casing 324 into the injection head 325 and the well head device 36 smoothly, mechanical arms may be used for towing and positioning, or a wedge-shaped or cone-shaped guide structure may also be used for guiding. By the present disclosure, the drilling coiled tubing 322 and the coiled tubing as a casing 324 are provided respectively by the roller for drilling 321 and the roller for running casing 323 arranged on the underwater derrick 31. Through the cooperation of an injection head 325 and a well head device 36, the drilling coiled tubing 322 and the coiled tubing as a casing 324 respectively enter the well according to the requirements, so that drilling and casing running operations can be realized on the basis of not moving the underwater derrick 31 or not changing the self structure of the underwater derrick 31. Further, operation steps can be simplified, and the work efficiency can be improved. In addition, the subsea drilling device 3 is directly placed into the subsea rather than using a semi-submersible drilling platform, which can reduce the drilling cost. In addition, a structure with a dual-roller coiled tubing device 32 is adopted, which can realize the operation of drilling once and running the casing once. So, the connecting time is omitted, and the drilling efficiency is greatly improved.

Figure 4:
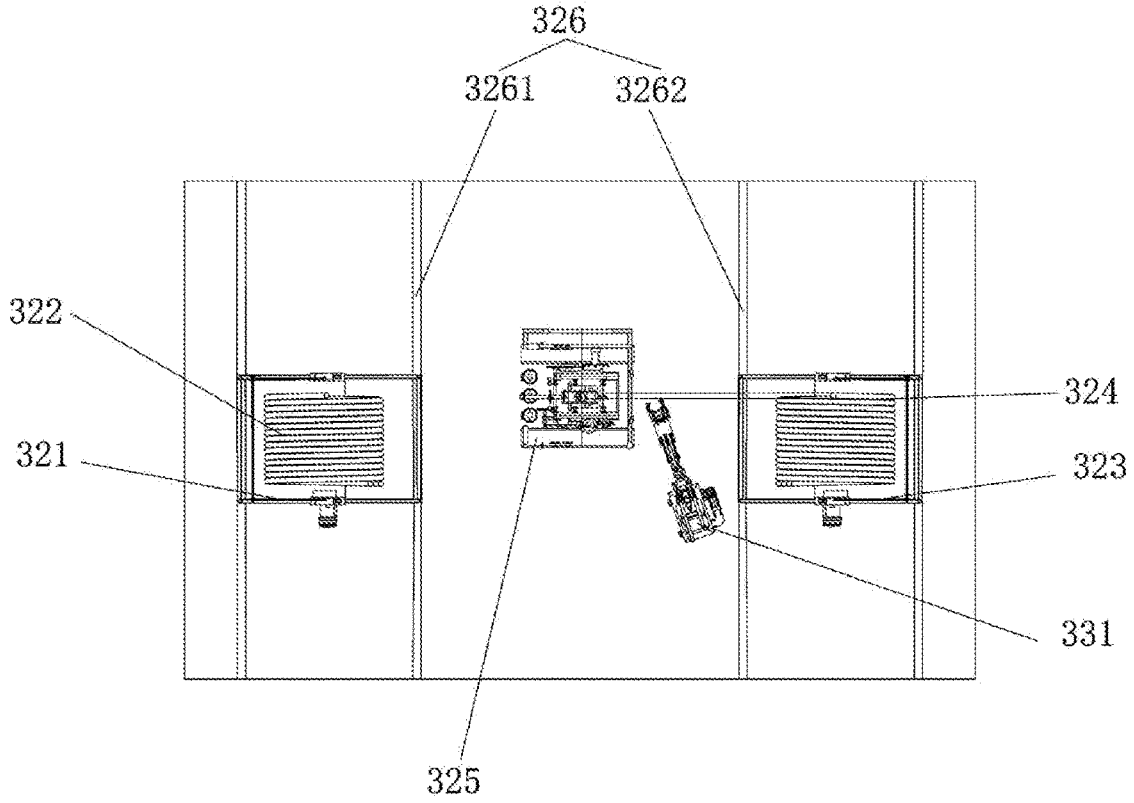
FIG. 4 is a schematic diagram of a dual-roller coiled tubing device according to the embodiments of the present disclosure.

As shown in FIG. 4, the subsea drilling device includes a guide rail device 326 arranged on the underwater derrick 31. The guide rail device 326 includes a first guide rail 3261 and a second guide rail 3262, and the first guide rail 3261 and the second guide rail 3262 respectively include two rails arranged in parallel. The roller for drilling 321 and the roller for running casing 323 are respectively arranged on the underwater derrick 31 via the first guide rail 3261 and the second guide rail 3262, and can move along the first guide rail 3261 and the second guide rail 3262 respectively. The moving track of the roller for drilling 321 on the first guide rail 3261 and the moving track of the roller for running casing 323 on the second guide rail 3262 can correspond to the injection head 325. That is, when the drilling coiled tubing 322 and the coiled tubing as a casing 324 are wound or unwound, the drilling coiled tubing 322 and the coiled tubing as a casing 324 can be ensured to be directly aligned with the injection head 325, the smoothness of the winding and unwinding processes can be ensured, and the sticking and the abrasion of the drilling coiled tubing 322 and the coiled tubing as a casing 324 can be avoided.

Figure 2:
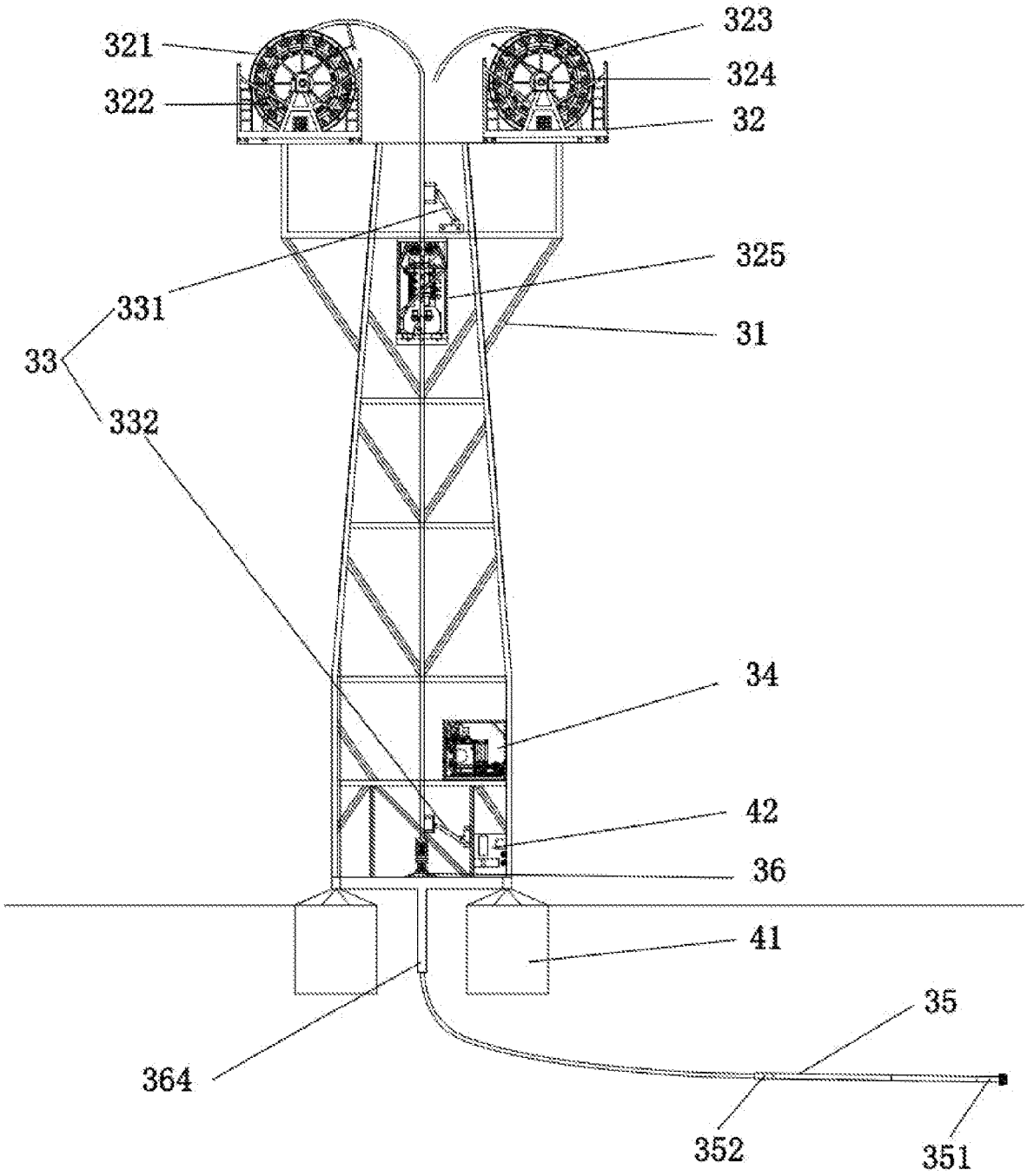
FIG. 2 is a schematic diagram of a subsea drilling device and a suction pile device according to the embodiments of the present disclosure.
Figure 5:
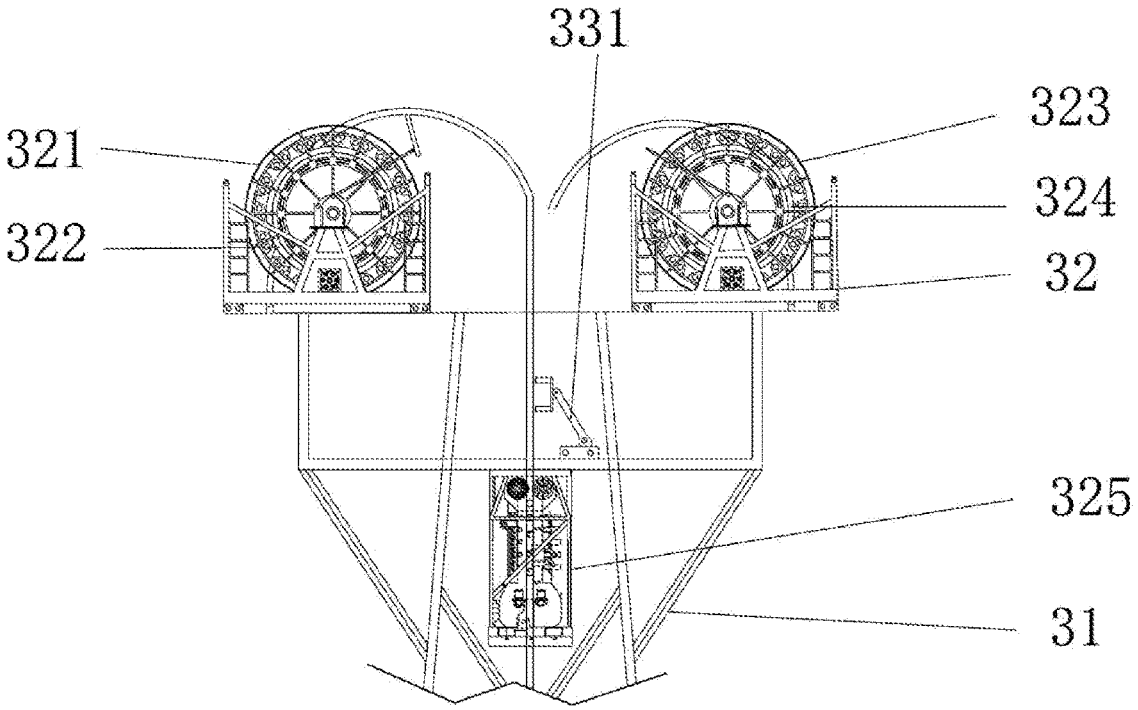
FIG. 5 is an enlarged schematic diagram of a top structure of FIG. 2.
Figure 6:
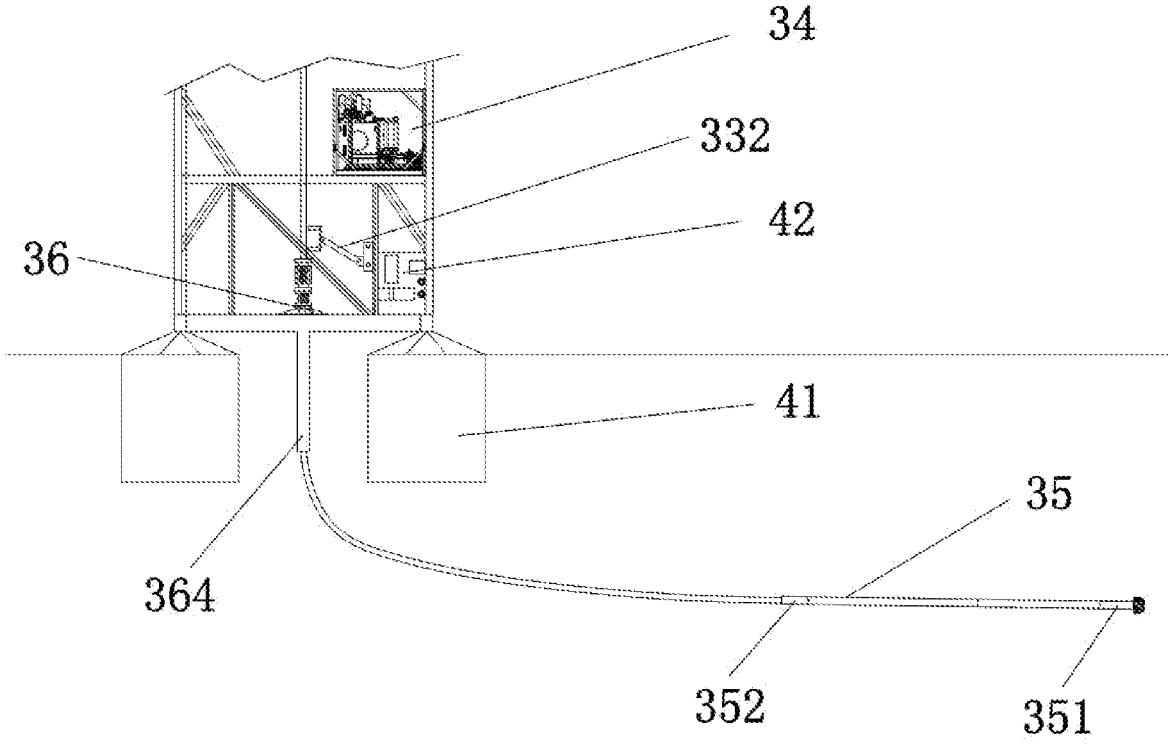
FIG. 6 is an enlarged schematic diagram of a bottom structure of FIG. 2.

In combination with the shown in FIG. 2, FIG. 5, and FIG. 6, the subsea drilling device includes a casing running auxiliary device 33 mounted on the underwater derrick 31. The casing running auxiliary device 33 may include a first mechanical arm 331 arranged close to the injection head 325 and a second mechanical arm 332 arranged close to the well head device 36. The first mechanical arm 331 is used for aligning the drilling coiled tubing 322 or the coiled tubing as a casing 324 with an upper inlet of the injection head 325. The second mechanical arm 332 is used for aligning the drilling coiled tubing 322 or the coiled tubing as a casing 324 with an upper inlet of the well head device 36.

In an initial state, that is, before the subsea drilling device 3 is lowered, the drilling coiled tubing 322 may be mounted into the injection head 325 and the well head device 36 first. When the drilling operation is completed, the drilling coiled tubing 322 is wound back before running the casing. Therefore, the drilling coiled tubing 322 does not need to be towed to aligned with a corresponding position by using the first mechanical arm 331 and the second mechanical arm 332, and the first mechanical arm 331 and the second mechanical arm 332 only need to perform actions when running the coiled tubing as a casing 324. That is, the first mechanical arm 331 is only used for mounting the coiled tubing as a casing 324 into the injection head 325, and the second mechanical arm 332 is only used for mounting the coiled tubing as a casing 324 into the well head device 36. Therefore, the first mechanical arm 331 and the second mechanical arm 332 with relatively simple structures and functions may be adopted, which can avoid complex structures thereof caused by over-high requirements on the action states of the mechanical arms, and can improve the stability and reliability of the operation of the mechanical arms.

As shown in FIG. 2 and FIG. 6, the subsea drilling device includes a downhole tool combination 35. The downhole tool combination 35 mainly includes a connector 352, a non-rotating joint, a lifting sub, a releasing tool, a conversion joint, a one-way valve, etc. The connector 352 is arranged at the top end of the downhole tool combination 35, and is used for connecting the drilling coiled tubing 322. An electric drill 351 is arranged at the bottom end of the downhole tool combination 35, and is used for drilling a borehole.

As shown in FIG. 1 to FIG. 6, the present disclosure further provides a subsea coiled tubing drilling system, which includes the aforementioned subsea drilling device 3, an auxiliary vessel 1, and a connecting pipe cable 2 for connecting the subsea drilling device 3 and the auxiliary vessel 1. The connecting pipe cable 2 includes a sling 23, an umbilical cable 24, and a material conveying pipe. Hoisting equipment is arranged on the auxiliary vessel 1, and the subsea drilling device 3 is lowered or recovered by using the sling 23. The umbilical cable 24 is used for providing power electricity signal, control signal, etc. from the auxiliary vessel 1 to the subsea drilling device 3. The material conveying pipe is used for providing related materials for drilling and cementing from the auxiliary vessel 1 to the subsea drilling device 3.

Figure 3:
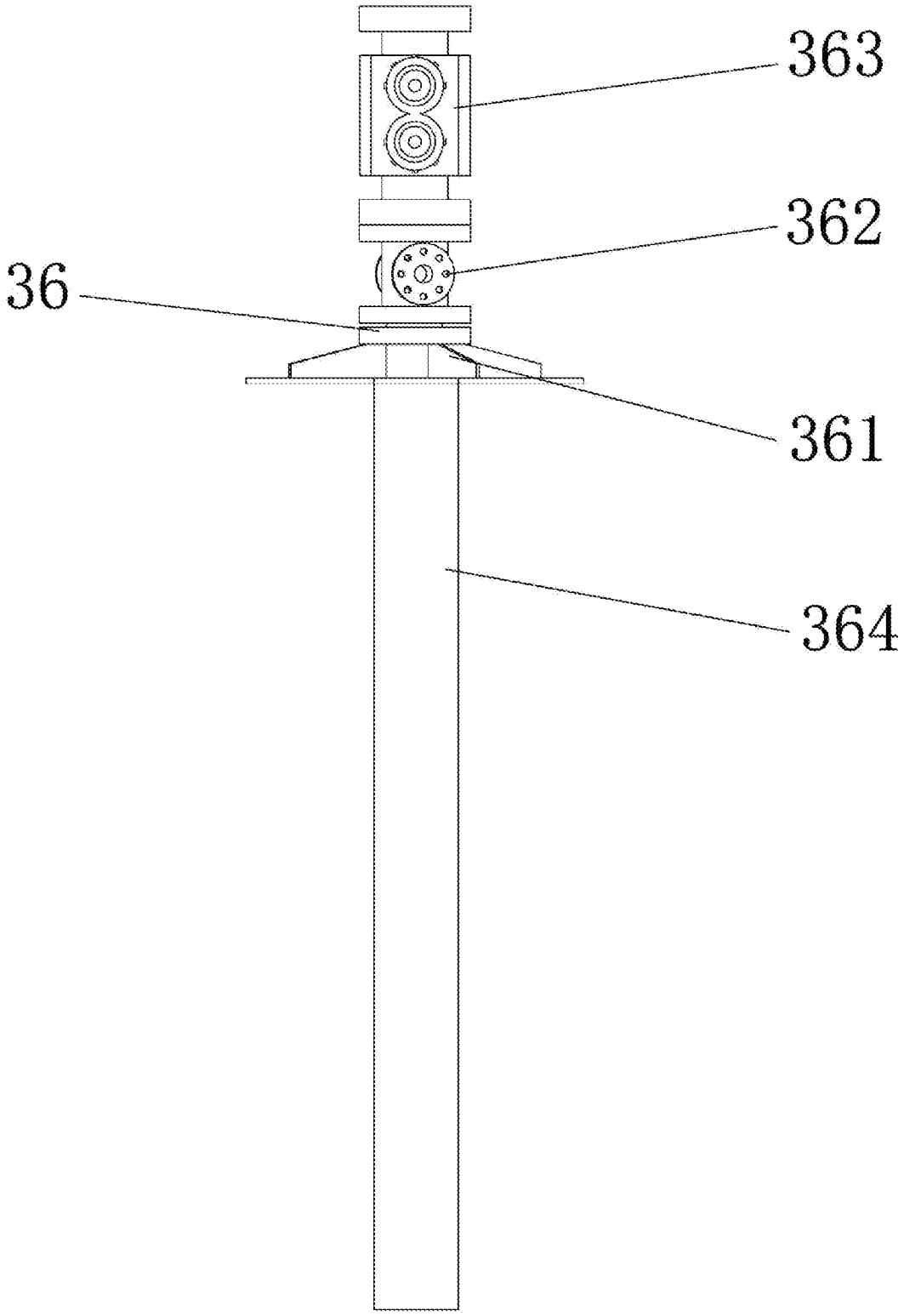
FIG. 3 is a schematic diagram of a well head device according to the embodiments of the present disclosure.

As shown in FIG. 3, the well head device 36 may include a well head base 361. The well head base 361 is mounted at the bottom of the underwater derrick 31. The well head base 361 is used for mounting well control equipment and well head equipment. A guide pipe 364 is arranged at the bottom of the well head base 361. A cement head 362 and a blowout preventer 363 are arranged at the top of the well head base 361 in sequence from bottom to top.

As shown in FIG. 1, the material conveying pipe includes a cement conveying pipe 21 and a mud conveying pipe 22. A mud and cement system 11 and a control system 12 are arranged on the auxiliary vessel 1. A hydraulic power station 34 is arranged on the subsea drilling device 3. The hydraulic power station 34 is mounted at the position, close to the bottom, of the underwater derrick 31. One end of the cement conveying pipe 21 is connected to the mud and cement system 11, and the other end of the cement conveying pipe 21 is connected to the cement head 362. The mud and cement system 11 conveys cementing cement to a position between the casing and a wellbore via the cement conveying pipe 21. One end of the mud conveying pipe 22 is connected to the mud and cement system 11, and the other end of the mud conveying pipe 22 is connected to the drilling coiled tubing 322. A drilling fluid flows through the mud conveying pipe 22, the drilling coiled tubing 322, and the downhole tool combination 35 in sequence, so as to reach the downhole. One end of the umbilical cable 24 is connected to the control system 12, and the other end of the umbilical cable 24 is connected to the hydraulic power station 34.

As shown in FIG. 1, FIG. 2, and FIG. 6, the subsea coiled tubing drilling system includes a suction pile device 4. The suction pile device 4 includes pile buckets 41 mounted on the periphery of the bottom of the underwater derrick 31 and a pump system 42 communicated with the pile buckets 41. The pump system 42 is mounted on the underwater derrick 31, and is used for filling water into the pile buckets 41 or discharging water from the pile buckets 41. Each of the pile buckets 41 is a bucket body structure with a closed top end and open bottom end. Under the action of the pump system 42, each of the pile buckets 41 penetrates below a mud layer of the subsea by using the dead-weight thereof and the pressure difference between the interior and the exterior of the corresponding one of the pile buckets.

The guide pipe 364 and the pile buckets 41 are all lower than the underwater derrick 31. When the subsea drilling device 3 is lowered, the guide pipe 364 and the pile buckets 41 enter the mud together. By the present disclosure, the underwater derrick 31 is fixed by using the suction pile device 4. The lifting movement of the underwater derrick 31 is realized by using the lifting of the pile buckets 41 before fixing. The guide pipe 364 of the well head device 36 and the pile buckets 41 of the suction pile device 4 are all arranged to be lower than the underwater derrick 31, so that the guide pipe 364 can be buried into the subsea mud synchronously when the underwater derrick 31 is lowered. Therefore, the position of a well head can be determined while mounting the underwater derrick 31, and the drilling coiled tubing 322 and the coiled tubing as a casing 324 can be fed into the well smoothly by using the well head device 36, so that the drilling and casing running operations can be completed smoothly.

A method of the present disclosure in a specific application is as follows.

The assembly of the whole system is completed on the land. The dual-roller coiled tubing device 32 is mounted at the upper end of the underwater derrick 31, and the well head device 36 is mounted at a central position of a bottom plate of the derrick. The drilling coiled tubing 322 is connected to the downhole tool combination 35 via the connector 352. The downhole tool combination 35 and the lower end of the drilling coiled tubing 322 penetrate through the injection head 325 in sequence and deepen into the guide pipe 364. The first mechanical arm 331 is mounted at the upper part of the underwater derrick 31, and the second mechanical arm 332 is mounted at the lower part of the underwater derrick 31. The pile buckets 41 are respectively mounted at the four corners of the bottom end of the underwater derrick 31. The mounted equipment is transported to the auxiliary vessel 1, and the connecting pipe cable 2 is mounted.

The equipment is transported to a designated position by the auxiliary vessel 1. The subsea drilling device 3 is connected to a side of the auxiliary vessel 1 and is lowered by using the sling 23, and the subsea drilling device 3 is lowered slowly when approaching a well head position. The pile buckets 41 enter the mud by means of the dead weight. The pump system 42 is started to pump the water out of the pile buckets 41. Each of the pile buckets 41 penetrates into the mud by using the pressure difference between the interior and the exterior of the corresponding one of the pile buckets 41. At this time, the guide pipe 364 and the pile buckets 41 enter the mud together, so as to lower the guide pipe 364. The pile buckets 41 are leveled horizontally by regulating flow. Meanwhile, the leveling and fixing of the subsea drilling device 3 are completed.

Coiled tubing drilling is started, the drilling fluid is conveyed into the well via the drilling coiled tubing 322, and the rock debris is discharged to a seabed. During drilling, the roller for drilling 321 moves reciprocally along the first guide rail 3261, so as to ensure that the drilling coiled tubing 322 can be directly aligned with the injection head 325 for lowering. When it is drilled to a required well depth, the drilling coiled tubing 322 is wound by rotating the roller for drilling 321, so as to lift the downhole tool combination 35. When the downhole tool combination 35 is completely lifted out of the wellbore to the position below the injection head 325, a clamping device of the injection head 325 is released, and the downhole tool combination 35 is continued to be lifted until it is completely lifted out of the injection head 325. The roller for drilling 321 is controlled to move rearward along the first guide rail. Meanwhile, the downhole tool combination 35 is driven to move rearward. When the downhole tool combination 35 is completely moved out to the rear side of the injection head 325, the movement of the roller for drilling 321 along the first guide rail 3261 is stopped, the first mechanical arm 331 is controlled to mount the coiled tubing as a casing 324 into the injection head 325, and the clamping device is controlled to clamp the coiled tubing as a casing 324. The roller for running casing 323 and the second guide rail 3262 are started, the coiled tubing as a casing 324 is lowered to the position of the well head, and the second mechanical arm 332 assists in mounting the coiled tubing as a casing 324 into the well head device 36 to perform a casing running operation. After the running of the casing is completed, a shear ram of the blowout preventer 363 is started to shear the coiled tubing as a casing 324 to complete the running of the casing. The remaining coiled tubing as a casing 324 is uplifted and wound by rotating the roller for running casing 323. After the running of the casing is completed, a cement head cap is closed. The cement is pumped into the cement head 362 by the mud and cement system 11 via the cement conveying pipe 21, so as to perform the cementing. After the cementing is completed, the pump system 42 is started to fill water into the pile buckets 41. Each of the pile buckets 41 is separated from the seabed by using the pressure difference between the interior and the exterior of the corresponding one of the pile buckets 41, and the subsea drilling device 3 is recovered to the auxiliary vessel 1 via the sling 23.

Specific examples are applied in the present disclosure to illustrate the principle and implementation mode of the present disclosure. The description of the above embodiments is merely used to help understand the method and its core idea of the present disclosure. Meanwhile, for those of ordinary skill in the art, there will be changes in the specific implementation mode and application scope according to the idea of the present disclosure. In conclusion, the content of the present specification shall not be construed as a limitation to the present disclosure.

What is claimed is:

1. A subsea drilling device, comprising:
- an underwater derrick;
- a well head device mounted at a bottom of the underwater derrick; and
- a dual-roller coiled tubing device mounted at a top of the underwater derrick,
- wherein:
  - the dual-roller coiled tubing device comprises an injection head, a roller for drilling and a roller for running casing;
  - the injection head is arranged right above the well head device;
  - the roller for drilling and the roller for running casing are distributed on two sides of the injection head;
  - the roller for drilling is configured for winding and unwinding a drilling coiled tubing;
  - the roller for running casing is configured for winding and unwinding a coiled tubing as a casing; and
  - both the drilling coiled tubing and the coiled tubing as a casing are capable of respectively penetrating through the injection head and the well head device in sequence.

2. The subsea drilling device according to claim 1, wherein:
- the roller for drilling and the roller for running casing are respectively arranged on the underwater derrick via a first guide rail and a second guide rail; and
- both a moving track of the roller for drilling on the first guide rail and a moving track of the roller for running casing on the second guide rail are capable of corresponding to the injection head.

3. The subsea drilling device according to claim 1, comprising a casing running auxiliary device, wherein the casing running auxiliary device comprises a first mechanical arm arranged close to the injection head and a second mechanical arm arranged close to the well head device.

4. The subsea drilling device according to claim 2, comprising a casing running auxiliary device, wherein the casing running auxiliary device comprises a first mechanical arm arranged close to the injection head and a second mechanical arm arranged close to the well head device.

5. The subsea drilling device according to claim 3, wherein:
- in an initial state, the drilling coiled tubing is mounted inside the injection head and the well head device;
- before running a casing, the drilling coiled tubing is wound back;
- the first mechanical arm is configured for mounting the coiled tubing as a casing into the injection head; and
- the second mechanical arm is configured for mounting the coiled tubing as a casing into the well head device.

6. The subsea drilling device according to claim 4, wherein:
- in an initial state, the drilling coiled tubing is mounted inside the injection head and the well head device;
- before running a casing, the drilling coiled tubing is wound back;
- the first mechanical arm is configured for mounting the coiled tubing as a casing into the injection head; and
- the second mechanical arm is configured for mounting the coiled tubing as a casing into the well head device.

7. The subsea drilling device according to claim 3, comprising a downhole tool combination, wherein:

a connector is arranged at a top end of the downhole tool combination;

the connector is configured for connecting with the drilling coiled tubing;

an electric drill is arranged at a bottom end of the downhole tool combination; and the electric drill is configured for drilling a borehole.

8. The subsea drilling device according to claim 4, comprising a downhole tool combination, wherein:

a connector is arranged at a top end of the downhole tool combination;

the connector is configured for connecting with the drilling coiled tubing;

an electric drill is arranged at a bottom end of the downhole tool combination; and the electric drill is configured for drilling a borehole.

9. A subsea coiled tubing drilling system, comprising:

a subsea drilling device;

an auxiliary vessel; and a connecting pipe cable for connecting the subsea drilling device and the auxiliary vessel, wherein:

the subsea drilling device comprises:

an underwater derrick;

a well head device mounted to a bottom of the underwater derrick; and a dual-roller coiled tubing device mounted at a top of the underwater derrick;

the dual-roller coiled tubing device comprises an injection head, a roller for drilling and a roller for running casing;

the injection head is arranged right above the well head device;

the roller for drilling and the roller for running casing are distributed on two sides of the injection head;

the roller for drilling is configured for winding and unwinding a drilling coiled tubing;

the roller for running casing is configured for winding and unwinding a coiled tubing as a casing;

both the drilling coiled tubing and the coiled tubing as a casing are capable of respectively penetrating through the injection head and the well head device in sequence; and the connecting pipe cable comprises a sling, an umbilical cable, and a material conveying pipe.

10. The subsea coiled tubing drilling system according to claim 9, wherein the well head device comprises:

a well head base;

a guide pipe arranged at a bottom of the well head base; and a cement head and a blowout preventer arranged at a top of the well head base in sequence from bottom to top.

11. The subsea coiled tubing drilling system according to claim 10, wherein:

the material conveying pipe comprises a cement conveying pipe and a mud conveying pipe;

a mud and cement system and a control system is arranged on the auxiliary vessel;

a hydraulic power station is arranged on the subsea drilling device, a first end of the cement conveying pipe is connected to the mud and cement system, a second end of the cement conveying pipe is connected to the cement head, a first end of the mud conveying pipe is connected to the mud and cement system, and a second end of the mud conveying pipe is connected to the drilling coiled tubing; and a first end of the umbilical cable is connected to the control system, and a second end of the umbilical cable is connected to the hydraulic power station.

12. The subsea coiled tubing drilling system according to claim 10, comprising a suction pile device, wherein the suction pile device comprises:

pile buckets mounted on a periphery of the bottom of the underwater derrick; and a pump system that communicates with the pile buckets, wherein the pump system is configured for filling water into the pile buckets or discharging water from the pile buckets.

13. The subsea coiled tubing drilling system according to claim 12, wherein the guide pipe and the pile buckets are all lower than the underwater derrick, and the guide pipe and the pile buckets enter the mud together when the subsea drilling device is lowered.

14. The subsea coiled tubing drilling system according to claim 9, wherein:

the roller for drilling and the roller for running casing are respectively arranged on the underwater derrick via a first guide rail and a second guide rail; and both a moving track of the roller for drilling on the first guide rail and a moving track of the roller for running casing on the second guide rail are capable of corresponding to the injection head.

15. The subsea coiled tubing drilling system according to claim 9, comprising a casing running auxiliary device, wherein the casing running auxiliary device comprises a first mechanical arm arranged close to the injection head and a second mechanical arm arranged close to the well head device.

16. The subsea coiled tubing drilling system according to claim 15, wherein:

in an initial state, the drilling coiled tubing is mounted inside the injection head and the well head device;

before running a casing, the drilling coiled tubing is wound back;

the first mechanical arm is configured for mounting the coiled tubing as a casing into the injection head; and the second mechanical arm is configured for mounting the coiled tubing as a casing into the well head device.

17. The subsea coiled tubing drilling system according to claim 15, comprising a downhole tool combination, wherein:

a connector is arranged at a top end of the downhole tool combination, and the connector is configured for connecting with the drilling coiled tubing; and an electric drill is arranged at a bottom end of the downhole tool combination, and the electric drill is configured for drilling a borehole.

* * * * *